US006358093B1

(12) United States Patent
Phommachanh et al.

(10) Patent No.: US 6,358,093 B1
(45) Date of Patent: Mar. 19, 2002

(54) NORMAL THROUGH JACK AND METHOD

(75) Inventors: Chansy Phommachanh, Shakopee; Roy Lee Henneberger, Apple Valley; Gregory D. Spanier, Shakopee; David DeYoung, Minneapolis, all of MN (US)

(73) Assignee: ADC Telecommunications, Inc., Minnetonka, MN (US)

( * ) Notice: Subject to any disclaimer, the term of this patent is extended or adjusted under 35 U.S.C. 154(b) by 0 days.

(21) Appl. No.: 09/778,667

(22) Filed: Feb. 7, 2001

(51) Int. Cl.[7] ..... H01R 13/66

(52) U.S. Cl. ..... 439/620; 439/676; 439/76.1; 439/188

(58) Field of Search ..... 439/620, 676, 439/188, 540.1, 541.5, 76.1

(56) References Cited

U.S. PATENT DOCUMENTS

| | | | | |
|---|---|---|---|---|
| 3,222,471 | A | 12/1965 | Steinkamp | 200/51.07 |
| 4,158,472 | A | 6/1979 | Seiden et al. | 431/502 |
| 4,264,115 | A | 4/1981 | Chow | 439/180 |
| 4,752,679 | A | 6/1988 | Wehrmacher | 235/382 |
| 4,944,698 | A | 7/1990 | Siemon et al. | 439/676 |
| 4,952,170 | A | 8/1990 | Pritulsky | 439/509 |
| 5,030,123 | A | 7/1991 | Silver | 439/188 |
| 5,074,801 | A | 12/1991 | Siemon | 439/188 |
| 5,123,854 | A | 6/1992 | Petersen et al. | 439/188 |
| 5,156,552 | A | 10/1992 | Zaderej et al. | 439/59 |
| 5,161,988 | A | 11/1992 | Krupka | 439/136 |
| 5,178,554 | A | 1/1993 | Siemon et al. | 439/188 |
| 5,263,872 | A | 11/1993 | Marpoe, Jr. et al. | 439/188 |
| 5,273,448 | A | 12/1993 | Myer et al. | 439/188 |
| 5,328,380 | A | 7/1994 | Carney | 439/188 |
| 5,346,405 | A | 9/1994 | Mosser, III et al. | 439/188 |
| 5,387,135 | A | 2/1995 | Shen et al. | 439/676 |
| 5,399,107 | A | 3/1995 | Gentry et al. | 439/676 |
| 5,420,920 | A | 5/1995 | Capper et al. | 379/413.04 |
| 5,432,847 | A | 7/1995 | Hill et al. | 379/328 |
| 5,483,573 | A | 1/1996 | Steenton et al. | 379/2 |
| 5,492,478 | A | 2/1996 | White | 439/76.2 |
| 5,584,713 | A | 12/1996 | Kato et al. | 439/188 |
| 5,867,576 | A | 2/1999 | Norden | 379/438 |
| 6,012,936 | A | 1/2000 | Siemon et al. | 439/188 |
| 6,056,568 | A | 5/2000 | Arnett | 439/188 |
| 6,059,578 | A | 5/2000 | Arnett | 439/43 |
| 6,079,996 | A | 6/2000 | Arnett | 439/188 |
| 6,099,333 | A | 8/2000 | Dauod et al. | 439/188 |
| 6,106,335 | A | 8/2000 | Merchant et al. | 439/620 |
| 6,139,343 | A | 10/2000 | Arnett | 439/188 |
| 6,142,802 | A | 11/2000 | Berg et al. | 439/180 |
| 6,146,167 | A | 11/2000 | Kutsch | 439/188 |
| 6,162,077 | A | 12/2000 | Laes et al. | 439/188 |
| 6,186,805 | B1 | 2/2001 | Krishnaswamy et al. | 439/188 |
| 6,186,833 | B1 | 2/2001 | Wu | 439/668 |

OTHER PUBLICATIONS

Document entitled "Smart 16/32™ Patch Panels," printed from internet site www.rittech.com/ecatalog/code/48_des.html, dated Jan. 30, 2001, 4 pages.

*Primary Examiner*—Tadsidon C Patel

(57) ABSTRACT

A modular jack assembly for connecting and switching computer network cables. The jack assembly includes at least one jack module with two sets of connectors for linking wires from cables to the module and at least one jack. The modules within jack assembly slide between a first position and a second position. In the first position, the two sets of connectors linked to cables are electrically connected to each other, allowing normal through signal transmission. In the second position, the electrical connection between the connector sets is broken and the plug contacts within each jack are linked to one of the sets of connectors, allowing pass-through connections, such as a cross-connection, to be made.

13 Claims, 8 Drawing Sheets

NORMAL THROUGH JACK AND METHOD

FIELD OF THE INVENTION

The present invention relates to the field of modular jacks for use in the telecommunications industry. More specifically, this invention relates to a switching jack which allows selection of normal-through signal flow or pass-through signal flow for use in telecommunications network applications.

BACKGROUND OF THE INVENTION

When building or extending a Local Area Network (LAN) or other similar telecommunications environment, some ability to connect sets of cables is required. Often, this need arises when a backbone or horizontal cable is connected to a LAN segment. In this situation, the workstations of the LAN segment are cabled and the cables from these workstations are gathered together in a wiring enclosure. The backbone cable is also led into the same enclosure. The individual cables from the workstations are split into twisted pairs and the pairs of wires are connected with a set of insulation displacement connectors (IDCs) or other connectors. These connectors are electrically connected to a set of modularjacks according to industry wiring standards. The backbone is also broken into appropriate twisted wire pairs and connecting to a separate set of IDCs or other connectors. These second connectors are then linked to another set of modular jacks according to industry wiring standards. Links between the backbone cable and the workstation cables are made by connecting a backbone modularjack to a workstation modular jack with a cross-connect patch cable.

This sort of LAN wiring arrangement can lead to confusion and management difficulties since every single network link in that particular wiring enclosure requires a cross-connect patch cable. Labeling and managing these cables can quickly become quite difficult with large or even moderately sized networks.

To address these shortcomings, a different type of modular jack arrangement was created, called a normal through jack assembly. Normal through jack assemblies might include a pair of modular jacks, one of the modular jacks electrically linked to a first connector for connecting to a backbone cable, the other modular jack electrically linked to a second connector for connecting to a workstation cable, and circuitry connecting the two jacks. The circuitry connecting the jacks would provide electrical connectivity between the two sets of connectors linked to the jacks such that when no plug has been inserted in either jack, a direct connection between the connectors is maintained. This is referred to as the normal through condition. Changes to this normal condition may be required when a network user temporarily moves to a new workstation or when there is a problem with a port in a hub or router either downstream or upstream of the normal through jack assembly. When a plug is inserted into either jack, the normal through condition is broken and the connectors linked to that jack are electrically linked to the plug's conductors. Then the jack assembly can be used as a traditional cross-connect operation. This arrangement has the effect of reducing the number of cross-connect cables required to maintain the operational status of the network.

Current normal through jacks use a variety of means to accomplish these normal and cross-connect functions. Prior art normal through jacks are disclosed in U.S. Pat. Nos. 5,074,801, 5,161,988, and 5,178,554. Issues regarding these jacks and other jacks have arisen with respect to durability, complexity of design and construction, and the ability to avoid signal degradation due to cross-talk at higher levels of data transmission speed.

SUMMARY OF THE INVENTION

One preferred embodiment of the present invention is a jack apparatus and method for connecting and switching network cables. The jack includes at least one jack module with two sets of connectors for linking wires from cables to the module and at least one jack. The modules within the jack slide between a first position and a second position. In the first position, the two sets of connectors linked to cables are electrically connected to each other, allowing normal through signal transmission. In the second position, the electrical connection between the connector sets is broken and the contacts within each jack are linked to one of the sets of connectors, allowing pass-through connections, such as a cross-connection, to be made through plugs received by the jacks.

BRIEF DESCRIPTION OF THE DRAWINGS

The accompanying drawings, which are incorporated in and constitute a part of the description, illustrate several aspects of the invention and together with the description, serve to explain the principles of the invention. A brief description of the drawings is as follows.

DETAILED DESCRIPTION OF THE INVENTION

Figure 1:
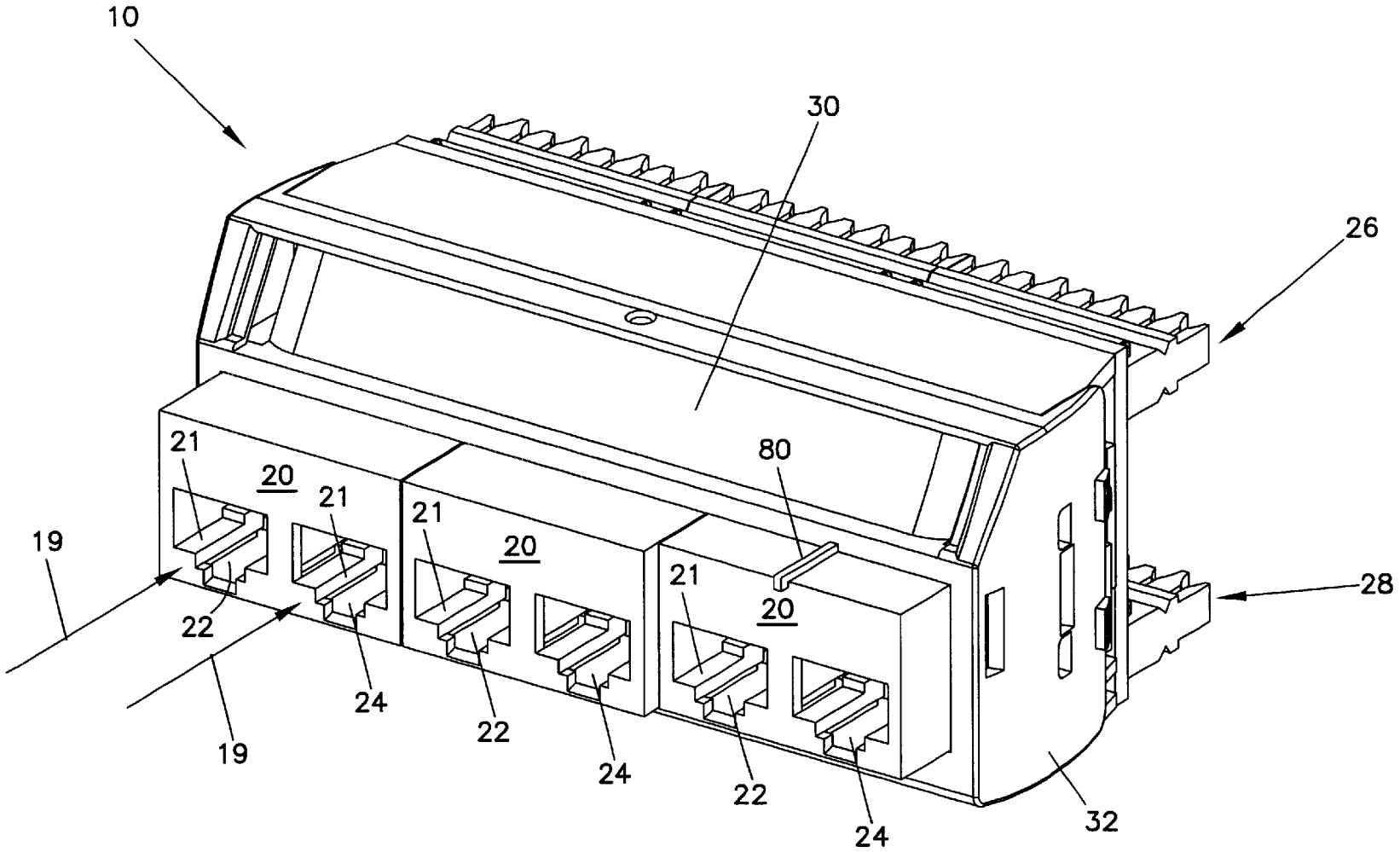
FIG. 1 is a front perspective view of a preferred embodiment of a normal through jack assembly containing three jack modules.

Referring now to FIGS. 1–8, a normal through jack assembly 10 is shown which contains three normal through jack modules 20. The three-module unit illustrated is one preferred embodiment. Single module units, and other densities of jacks are possible and may be desirable or required for a particular application. On the front of each module 20 are two jacks 22, 24 with plug openings 21 for receiving standard RJ-45 plugs in the direction of axes 19. Use of other plug formats and different jacks 22, 24 for receiving those plugs is anticipated.

Mounted to the rear of each module 20 are connection locations 23, 25. In the illustrated embodiment, connection locations 23, 25 are configured as upper and lower rows 27, 29 of insulation displacement connectors (IDCs) 26, 28 respectively. IDCs 26, 28 are multi-wire connector blocks. Use of alternative connector types for linking cables to jack assembly 10 is anticipated.

Jack modules 20 each contain a switch for providing selective circuit pathways between pairs of connection locations 23, 25 in a normal through condition, and each jack 22, 24 and a respective connection location 23, 25 in a pass-through or cross-connect condition. In the normal through condition, each one of jacks 22, 24 is preferably electrically isolated from the rest of the circuit. In the pass-through condition, the electrical path between the pairs of connection locations 23, 25 is broken. In the preferred embodiment, when the normal through condition is broken, aback 22 is connected to one of rear connectors 26, and a jack 24 is connected to one of rear connectors 28.

Front cover 32 provides an opening 68 sized to allow the front of each module 20 to be accessible from the front of jack assembly 10. The rightmost jack module 20 in FIG. 1 is shown more deeply inserted into jack assembly 10 than the other two modules 20. In this position, the rightmost module 20 is in non-normal through mode. The other two modules 20 are shown fully extended and are in normal through mode. Front cover 32 also provides a labeling surface 30 where indicia of devices connected to jacks 22, 24 may be placed.

Figure 2:
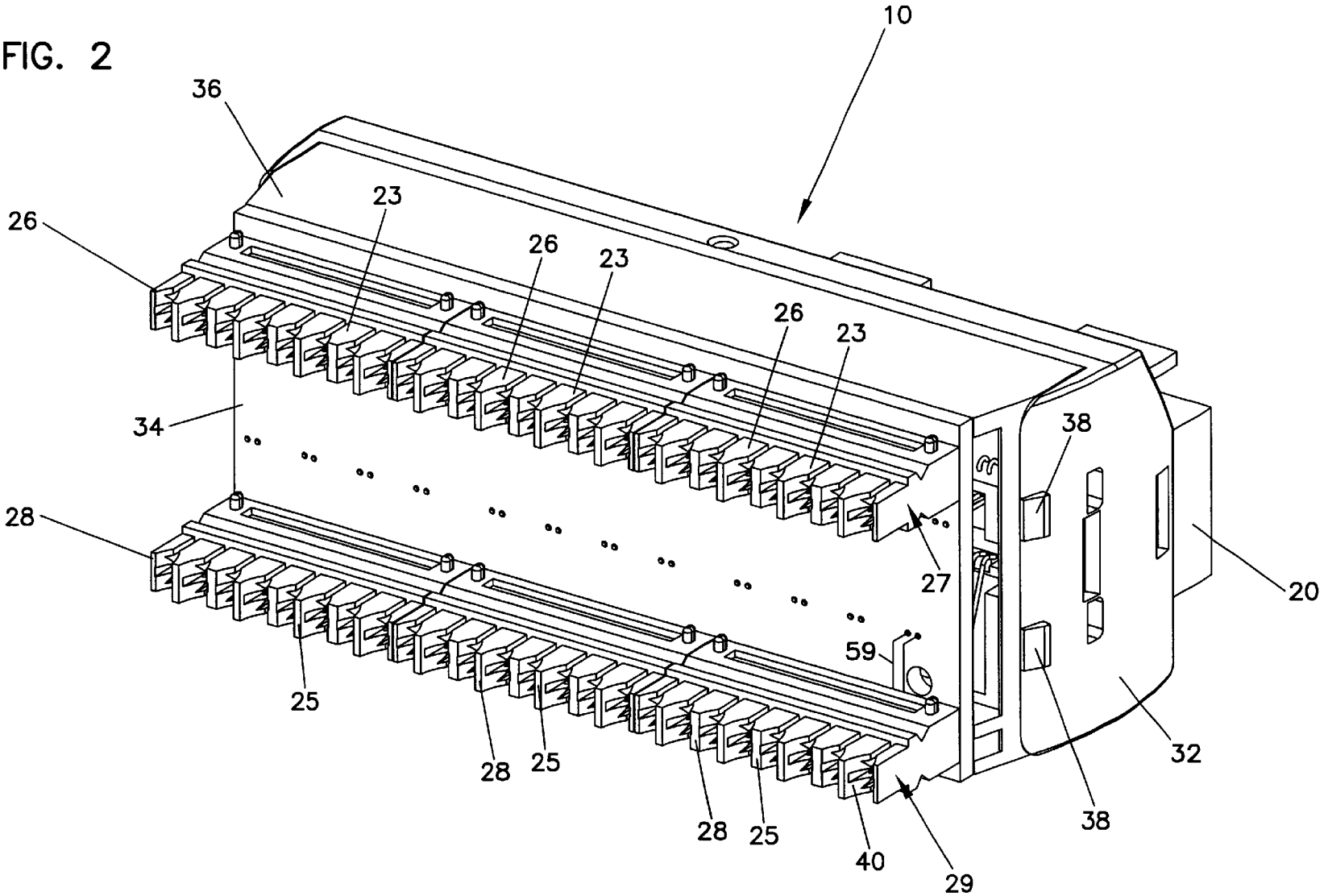
FIG. 2 is a rear perspective view of the jack assembly in FIG. 1.

Referring now to FIG. 2, additional details of jack assembly 10 may be seen. From this view, it can be seen that front cover 32 fits on rear cover 36 and is removably held in place on rear cover 36 by deformable tabs 38. Different arrangements for removably attaching front cover 32 on the jack assembly are anticipated. Upper and lower IDCs 26, 28 comprise eight individual connection points 40 per IDC 26, 28. Jack assembly 10 is intended to work with standard twisted pair data cables which consist of eight wires in four twisted pairs. Each IDC connection point 40 electrically connects to one of those wires and includes an outer housing and an inner conductor. Jack assembly 10 is configured to accept one such data cable per module at upper connector row 27 and one such data cable per module at lower connector row 29. Back plane 34 of jack assembly 10 serves as a mounting board for connectors 26 and 28. Back plane 34 is preferably a circuit board linking connectors 26, 28 with contacts used in the switching function of jack assembly 10. As shown, back plane 34 is a single board common to each switching jack module 20. Back plane 34 is mounted to rear cover 36 in any convenient manner, such as snaps, fasteners or other attachment methods.

Figure 3:
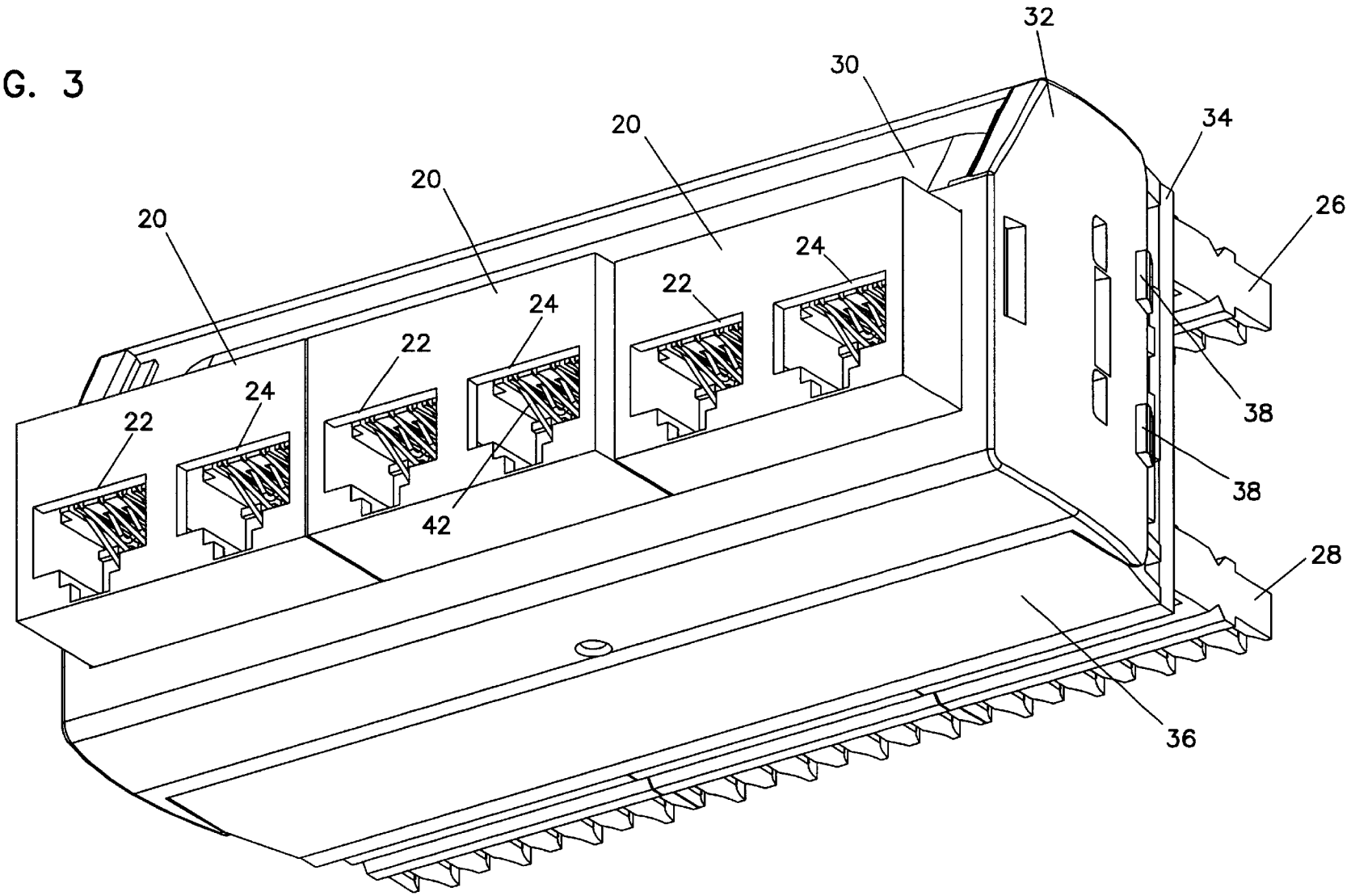
FIG. 3 is a further front perspective view of the jack assembly in FIG. 1.
Figure 4:
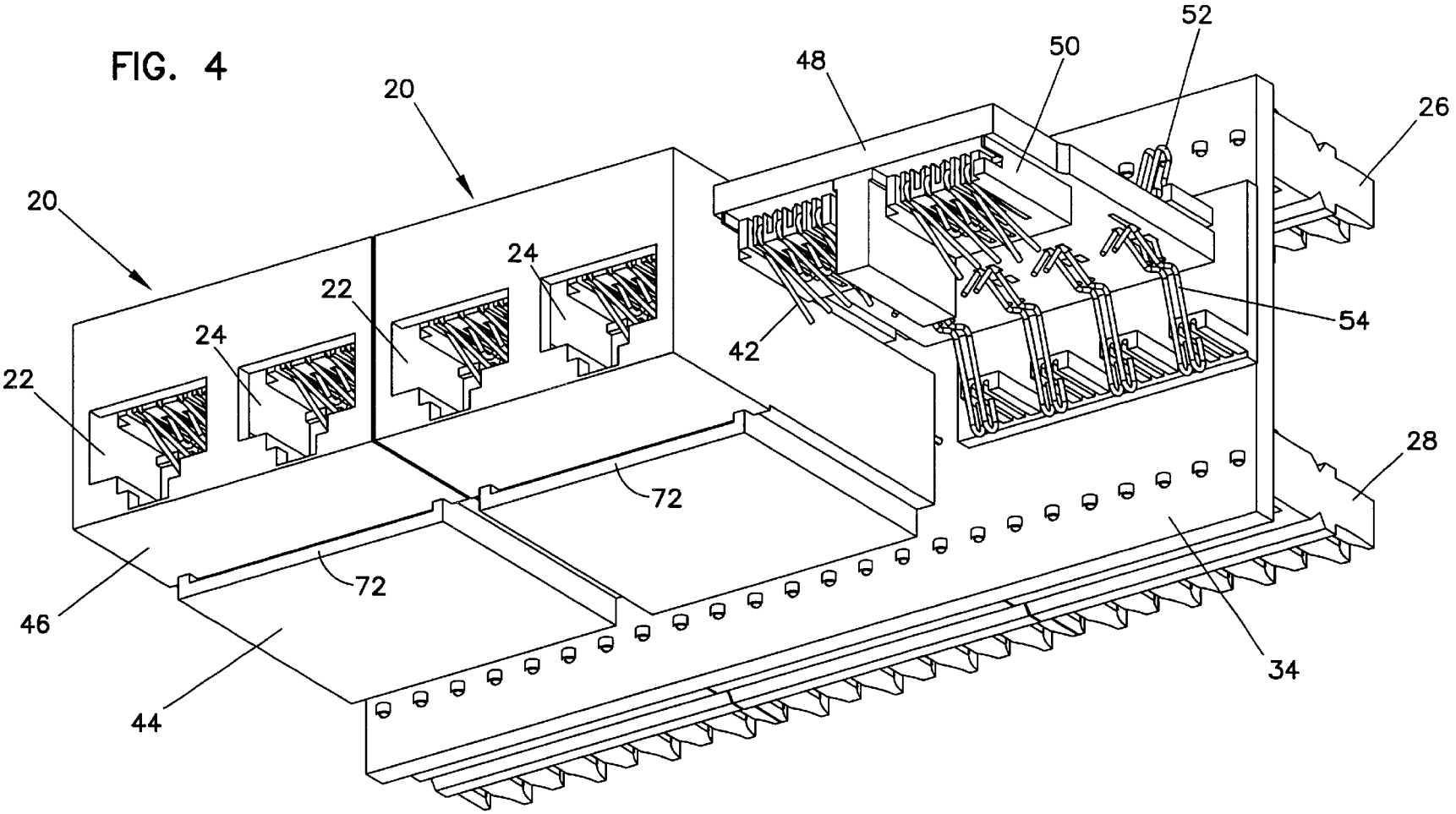
FIG. 4 is a further front perspective view of the jack assembly in FIG. 1 with a front cover and a rear cover removed and with portions of the housing of one of the jack modules removed.

FIG. 3 illustrates some further aspects of the front of jack assembly 10. Within each of jacks 22, 24, a series of front spring contacts 42 can seen. Spring contacts 42 are sized and positioned to mate with and make electrical contact with the contacts of standard RJ45 plugs inserted into jacks 22, 24. Eight spring contacts 42 are mounted within each jack 22, 24 and each of these spring contacts 42 is linked electrically with an IDC connection point 40 in IDCs 26, 28 in connector rows 27, 29 on the back of jack assembly 10 when a jack module 20 is in a non-normal through position. Further details regarding the method of electrically linking spring contacts 42 and IDCs 26, 28 will be described below.

Referring now to FIGS. 4–7, front cover 32 and rear cover 36 have been removed to show more details of jack modules 20. In addition, outer module housing 46 has been removed from the rightmost module 20. Spring contacts 42 within each jack 22 and 24 are held in a contact holder 50, and extend into slidable circuit board 48. Spring contacts 42 of jack 22 are electrically connected to circuit pathways or tracings 56 at via holes 58 on slidable circuit board 48. Each module 20 is contained within an outer module housing 46. These outer module housings 46 include lower module surfaces 44. When jack assembly 10 is fully assembled, lower module surfaces 44 rest on shelf 70 inside front cover 32. Front lip 72 of lower module surface 44 is engaged by inside ledge 74 of opening 70 to prevent module 20 from being removed from jack assembly 10, when front cover 32 is in place. Mounted on back plane 34 are upper circuit board spring contacts 52 and lower circuit board spring contacts 54. Spring contacts 52, 54 are held by holder 35. Eight upper spring contacts 52 and eight lower spring contacts 54 are mounted to the back plane 34 for each module. Each upper spring contact 52 is electrically connected to an IDC 26 in upper connector row 27 and each lower spring contact 54 is electrically connected to an IDC 28 in lower connector row 29 through tracings or circuit pathways 59 on back plane 34.

Figure 5:
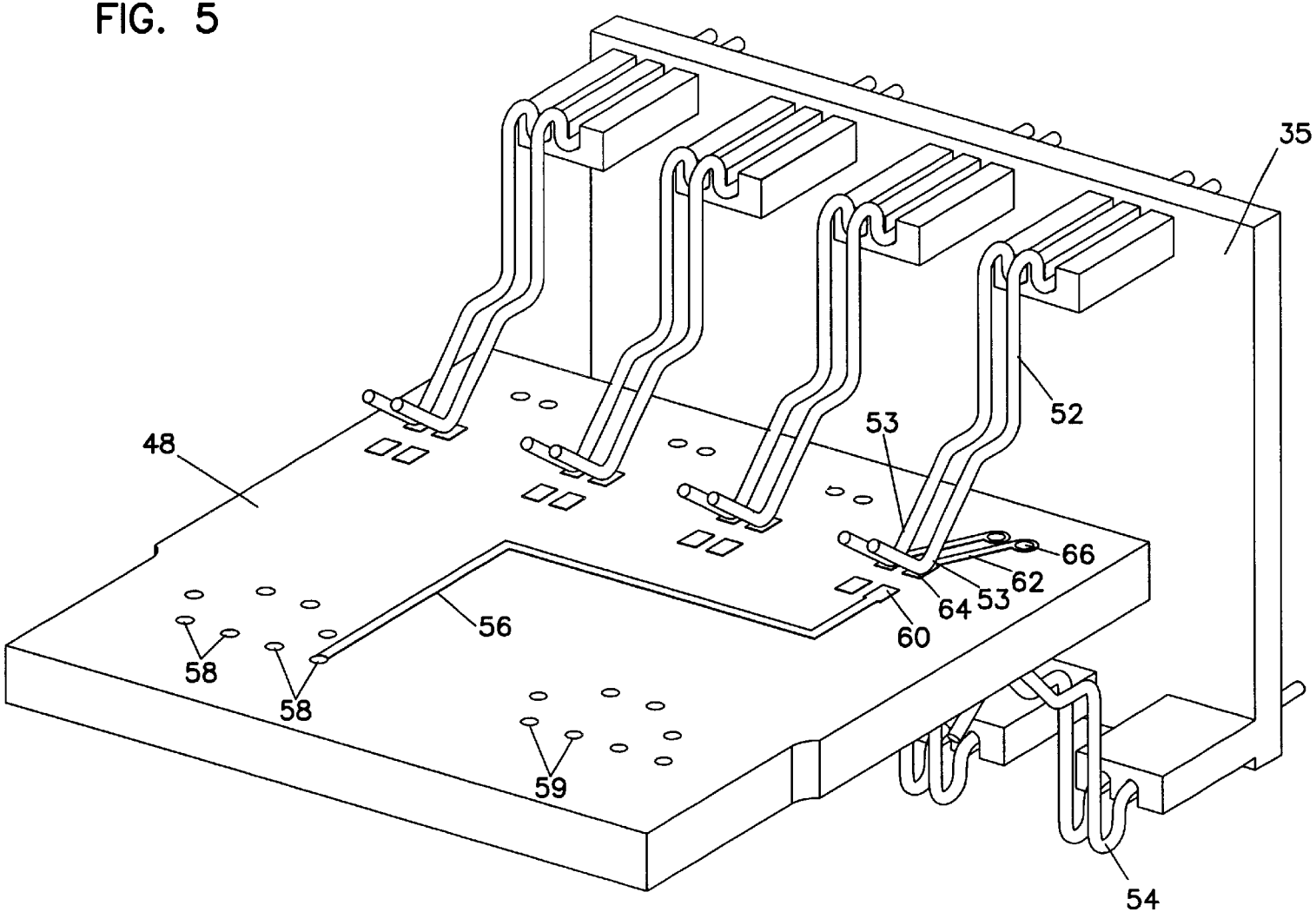
FIG. 5 is a front perspective view of the front circuit board, rear springs and rear spring holder of a single normal through jack module with illustrative circuit pathways shown on the circuit board.
Figure 6:
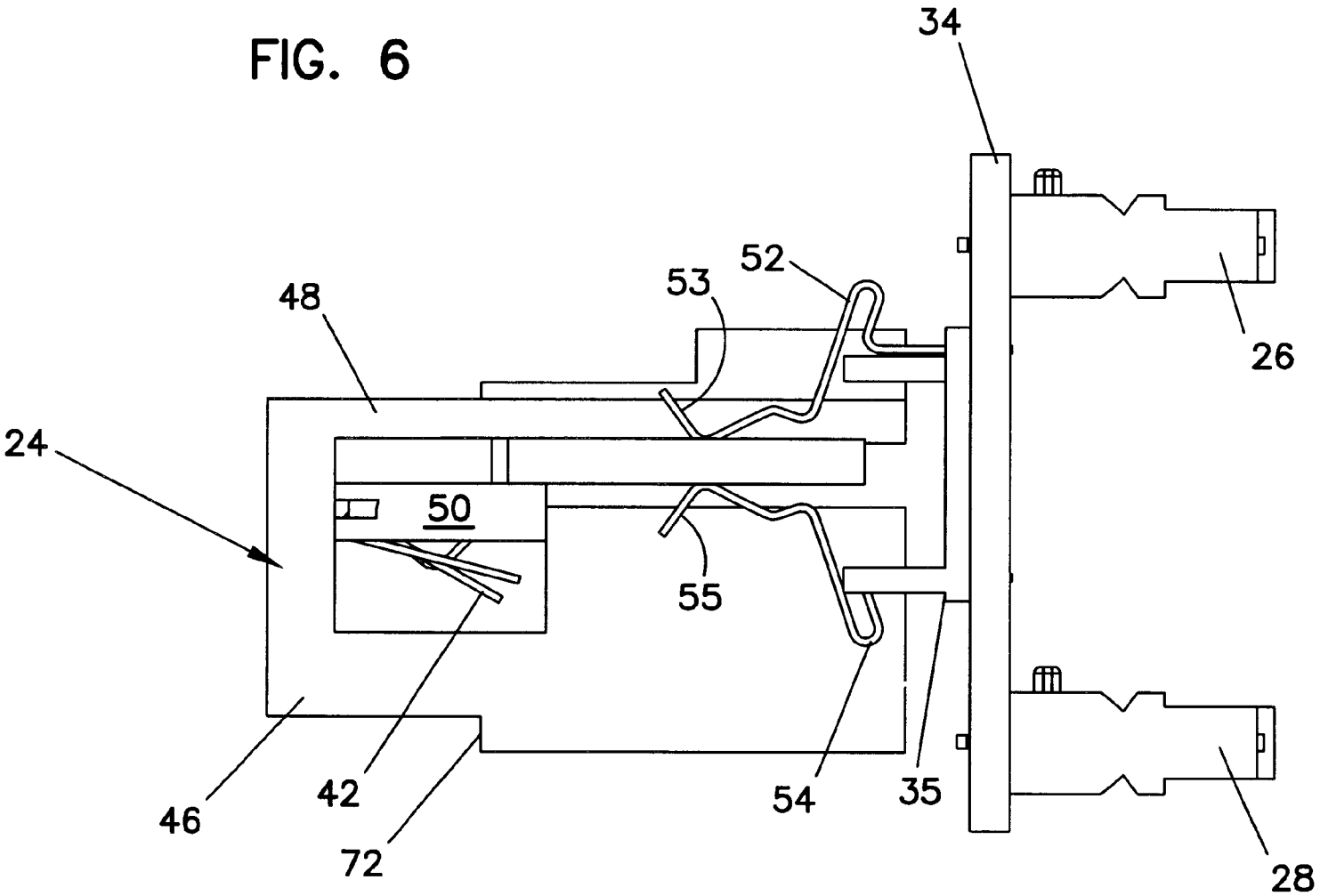
FIG. 6 is a side view of the jack portions in FIG. 4.
Figure 7:
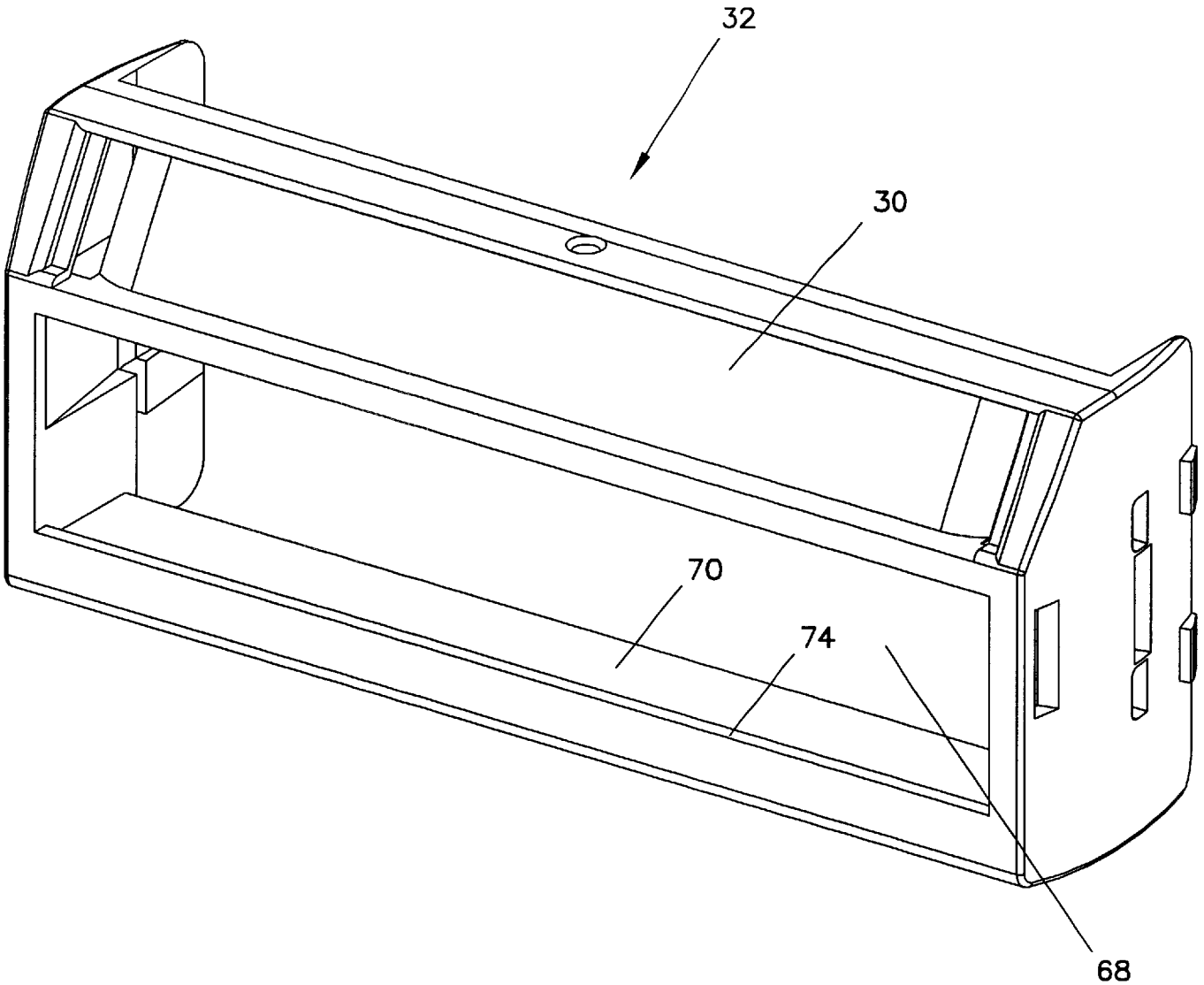
FIG. 7 is a front perspective view of the front cover for the jack assembly in FIG. 1.

Referring now to FIG. 5, illustrative electrical pathways 56, 62 are shown. Electrical pathway 56 extends from via holes 58 to contact pad 60. Each of the leftmost group of eight via holes 58 is electrically connected with a circuit pathway 56 to a contact pad 60 on the upper surface of slidable circuit board 48. Upper spring contacts 52 are positioned on top of and are in physical contact with the upper surface of slidable circuit board 48 at free ends 53. When a module 20 is in a non-normal through position, each of the upper spring contacts 52 are in physical contact with and electrically connected to a contact pad 60, thus completing an electrical circuit between contacts 42 of jack 22 and rear IDCs 26 of upper connector row 27.

Figure 8:
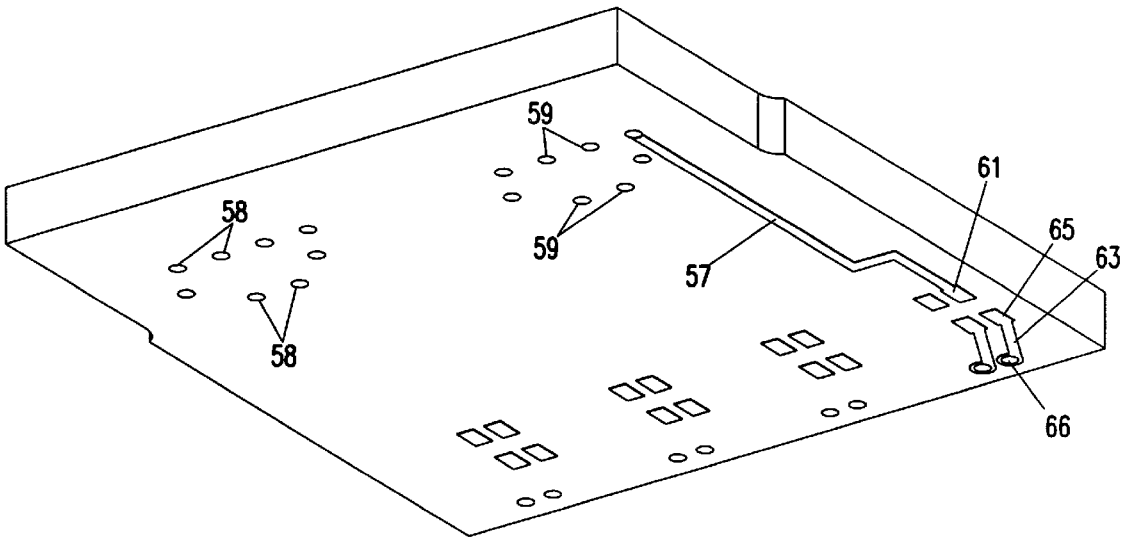
FIG. 8 is front perspective view of the underside of the front circuit board in FIG. 5 with illustrative circuit pathways shown.

Referring now to FIG. 8, on the underside of slidable circuit board 48 is a similar arrangement. Each of the rightmost group of eight via holes 59 is electrically linked with a circuit pathway 57 to contact pads 61 on the lower surface of slidable circuit board 48. Lower spring contacts 54 are positioned beneath and are in physical contact with the lower surface of slidable circuit board 48 at free ends 55. When a module 20 is in a non-normal through position, each of the lower spring contacts 54 are in physical contact with and electrically connected to a contact pad 61, thus completing an electrical circuit between contacts 42 of jack 24 and rear IDCs 28 of lower connector row 29.

Also on top of slidable circuit board 48 are normal contact pads 64. Normal circuit pathways or tracings 62 and normal via holes 66 are also provided. As shown in FIG. 5, when a module 20 is in the normal through position, upper spring contacts 52 are physically in contact with and electrically connected to normal contact pads 64, located on top slidable circuit board 48. Normal contact pads 64 are electrically connected to via holes 66 by normal circuit pathways 62, and via holes 66 extend through slidable circuit board 48. As shown in FIG. 8, on the underside of slidable circuit board 48, via holes 66 are electrically connected to normal contact pads 65 by normal circuit pathways 63. When a module 20 is in the normal through position, lower spring contacts 54 are physically in contact with and electrically connected to normal contact pads 65, and thus to via holes 66. In this normal through position, each IDC 26 in upper connector row 27 is electrically connected to an IDC 28 in lower connector row 29.

During use, module housing 46, spring contacts 42 and circuit board 48 slide longitudinally in the direction of insertion/removal of a plug in either of plug openings 21 in each module 20. The sliding movement causes switching of the circuit pathways in jack assembly 10, such that either a normal through or non-normal through pathway(s) is provided with respect to spring contacts 52, 54. Insertion of a plug in either jack 22, 24 causes both IDCs 26, 28 to be disconnected from one another and for each IDC 26, 28 to be connected to a jack 22, 24.

While each module 20 includes side-by-side jacks 22, 24, vertically stacked jacks are also possible.

At higher data transmission rates, it is not uncommon for cross talk between electrical pathways inside a jack to interfere with or degrade signal quality. Spacing the switching springs 52, 54 from the spring contacts 42 helps reduce cross-talk in jacks 22, 24. Preferably, upper spring contacts 52 and lower spring contacts 54 do not directly oppose one another through the circuit board 48. Because of the lateral offset of the contacts above and below slidable circuit board 48, contact pads 60 and 64 on the upper surface of slidable circuit board 48 are also laterally offset from contact pads 61 and 65 on the lower surface of slidable circuit board 48. These lateral offsets allow signal pathways within jack assembly 10 to be physically separated so as to help reduce the effects of cross-talk.

It is to be appreciated that module 20 can be moved from the normal position to the pass-through position at the same time as a plug is inserted, or before or after. If desired, a lock 80 (see FIG. 1) could be provided to lock module 20 in position. Lock 80 can be any convenient structure, such as a flexible tab that can selectively engage the remaining housing structure to hold module 20 in the selected position.

The above specification, examples and data provide a complete description of the design and use of the invention. Since many embodiments of the invention can be made without departing from the spirit and scope of the invention, the invention resides in the claims hereinafter appended.

What is claimed is:

1. A normal through telecommunications jack comprising:

a) a jack housing defining a front for receipt of a first plug and a second plug, each plug having plug contacts thereon;

b) first and second sets of jack contacts mounted to the jack housing;

c) first and second sets of spring contacts to engage the plug contacts of the first plug and the second plug, respectively;

d) a slideable circuit member carrying the first and second sets of spring contacts for movement therewith, the circuit member further including a plurality of sets of circuit components also for movement therewith, a first set of circuit components electrically connected with the first set of spring contacts, a second set of circuit components electrically connected with the second set of spring contacts, and a third set of circuit components spaced on the circuit member from both the first and second sets of circuit components, the slideable circuit member slideable between first and second positions wherein:

1) in the first position the first set of spring contacts is in electrical contact with the first set of jack contacts through the first set of circuit components, the second set of spring contacts is in electrical contact with the second set of jack contacts through the second set of circuit components, and the third set of circuit components is electrically isolated relative to the first and second sets of jack contacts; and 2) in the second position the first and second sets of circuit components are electrically isolated from the first and second sets of jack contacts, and the first and second sets of jack contacts are in electrical contact through the third set of circuit components.

2. The normal through telecommunications jack of claim 1, wherein the jack housing defines two longitudinal axes parallel to the direction of insertion of each plug, wherein the slideable circuit member slides in the direction of the longitudinal axes.

3. The normal through telecommunications jack of claim 1, wherein the first and second sets of jack contacts are flexible springs each having a free end, and further comprising a circuit board for holding the jack contacts to slideably engage the slideable circuit member at the free ends.

4. The normal through telecommunications jack of claim 3, wherein the first and second sets of jack contacts converge toward one another at the free ends of each contact.

5. The normal through telecommunications jack of claim 4, further comprising insulation displacement contacts mounted to the circuit board and in electrical contact with the jack contacts.

6. The normal through telecommunications jack of claim 1, wherein the slideable circuit member is a circuit board including tracings thereon defining the first, second and third circuit components.

7. A method of switching a normal through telecommunications jack comprising the steps of:

a) providing a jack housing defining a front for receipt of two plugs, each plug having plug contacts thereon, the jack housing including first and second sets of jack contacts;

b) inserting a plug into the jack housing so that one of first and second sets of spring contacts in the jack housing engage the plug contacts of the plug;

c) sliding a circuit member carrying the first and second sets of spring contacts, the circuit member further including a plurality of sets of circuit components also for movement therewith, a first set of circuit components electrically connected with the first set of spring contacts, a second set of circuit components electrically connected with the second set of spring contacts, and a third set of circuit components spaced on the circuit member from both the first and second sets of circuit components, the slideable circuit member slideable between first and second positions wherein:

1) in the first position the first set of spring contacts is in electrical contact with the first set of jack contacts through the first set of circuit components, the second set of spring contacts is in electrical contact with the second set of jack contacts through the second set of circuit components, and the third set of circuit components is electrically isolated relative to the first and second sets of jack contacts; and 2) in the second position the first and second sets of circuit components are electrically isolated from the first and second sets of jack contacts, and the first and second sets of jack contacts are in electrical contact through the third set of circuit components.

8. The method of claim 7, wherein the jack housing defines two longitudinal axes parallel to the direction of insertion of each plug, wherein the slideable circuit member slides in the direction of the longitudinal axes.

9. The method of claim 7, wherein the first and second sets of jack contacts are flexible springs each having a free end, and further comprising a circuit board for holding the jack contacts to slideably engage the slideable circuit member at the free ends.

10. The method of claim 8, wherein the first and second sets of jack contacts converge toward one another at the free ends of each contact.

11. The method of claim 8, further comprising insulation displacement contacts mounted to the circuit board and in electrical contact with the jack contacts.

12. The method of claim 8, wherein the slideable circuit member is a circuit board including tracings thereon defining the first, second and third circuit components.

13. A normal through telecommunications jack comprising:

a) a jack housing defining a front for receipt of a first connector having connector contacts thereon;

b) a set of jack contacts mounted to the jack housing;

c) a set of mating connector contacts to engage the contacts of the connector;

d) a slideable circuit member carrying the set of mating contacts for movement therewith, the circuit member further including a plurality of sets of circuit components also for movement therewith, a first set of circuit components electrically connected with the set of mating contacts, and a second set of circuit components spaced on the circuit member from the first set of circuit components, the slideable circuit member slideable between first and second positions wherein:

1) in the first position the set of mating contacts is in electrical contact with the set of jack contacts through the first set of circuit components, and the second set of circuit components is electrically isolated relative to the set of mating contacts; and 2) in the second position the first set of circuit component is electrically isolated from the set of jack contacts, and the set of jack contacts is in electrical contact with the second set of circuit components.

* * * * *